US009299480B2

(12) United States Patent
Worman et al.

(10) Patent No.: US 9,299,480 B2
(45) Date of Patent: Mar. 29, 2016

(54) SUBSEA POWER UMBILICAL

(75) Inventors: Peter J. Worman, Katy, TX (US); Baha Tulu Tanju, Humble, TX (US)

(73) Assignee: Chevron U.S.A. Inc., San Ramon, CA (US)

( * ) Notice: Subject to any disclaimer, the term of this patent is extended or adjusted under 35 U.S.C. 154(b) by 340 days.

(21) Appl. No.: 11/939,212

(22) Filed: Nov. 13, 2007

(65) Prior Publication Data

US 2009/0120632 A1 May 14, 2009

(51) Int. Cl.
*E21B 15/00* (2006.01)
*H01B 7/04* (2006.01)

(52) U.S. Cl.
CPC ..... *H01B 7/045* (2013.01)

(58) Field of Classification Search
CPC ..... H01B 7/045; H01B 7/14; H01B 7/17; H01B 7/18
USPC ..... 166/367, 345, 359, 242.1, 242.2; 174/47, 40; 405/169, 170, 405/224.2–224.4; 138/125, 130, 118, 137, 138/138; 385/101
See application file for complete search history.

(56) References Cited

U.S. PATENT DOCUMENTS 3,212,582 A * 10/1965 Brown ..... 166/242.2
4,196,307 A * 4/1980 Moore et al. ..... 174/47
4,476,923 A * 10/1984 Walling ..... 166/66.4
4,556,340 A * 12/1985 Morton ..... 405/224.2
4,821,804 A * 4/1989 Pierce ..... 166/367
4,952,012 A * 8/1990 Stamnitz ..... 385/101
5,042,903 A * 8/1991 Jakubowski ..... 385/101
5,506,818 A * 4/1996 Johnston ..... 367/144
5,667,649 A 9/1997 Bushman
5,902,958 A * 5/1999 Haxton ..... 174/47
5,908,049 A * 6/1999 Williams et al. ..... 138/125
5,913,337 A * 6/1999 Williams et al. ..... 138/125
5,921,285 A * 7/1999 Quigley et al. ..... 138/125

(Continued)

FOREIGN PATENT DOCUMENTS

EP DE 3012321 1/1981
EP CN 2845111 12/2006

(Continued)

OTHER PUBLICATIONS

PCT International Search Report and Written Opinion, International App. No. PCT/US 2008/079276, dated May 27, 2010.

(Continued)

*Primary Examiner* — James G Sayre
(74) *Attorney, Agent, or Firm* — Melissa Patangia; Nicholas F. Gallo; Christopher D. Northcutt

(57) ABSTRACT

An umbilical assembly for supplying power to subsea equipment includes an electrical conductor to convey an electrical current to the subsea equipment. An insulator surrounds the conductor. A support member is positioned between the insulator and the conductor. The support member has either non-magnetic properties or low-magnetic properties because of its material composition. The support member is adapted to connect to a structure at the surface of the sea. The support member supports the weight of the conductor. The supporting of the weight of the conductor by the support member can be to reduce creep typically associated with the conductor supporting its own weight. The support member can be used to hermetically seal the conductor and prevent hydrogen migration along the conductor.

24 Claims, 2 Drawing Sheets

(56) References Cited

U.S. PATENT DOCUMENTS

| | | | | |
|---|---|---|---|---|
| 6,012,495 | A * | 1/2000 | Antonsen | 138/131 |
| 6,046,404 | A * | 4/2000 | Figenschou et al. | 174/47 |
| 6,146,052 | A * | 11/2000 | Jacobsen et al. | 405/169 |
| 6,239,363 | B1 * | 5/2001 | Wooters | 174/47 |
| 6,283,206 | B1 * | 9/2001 | Fraser et al. | 166/242.3 |
| 6,355,879 | B1 * | 3/2002 | Bertini et al. | 174/47 |
| 6,397,948 | B1 | 6/2002 | Williams et al. | |
| 6,472,614 | B1 * | 10/2002 | Dupont et al. | 174/70 S |
| 6,538,198 | B1 * | 3/2003 | Wooters | 174/47 |
| 6,612,370 | B1 * | 9/2003 | Jahnsen et al. | 166/367 |
| 6,638,198 | B1 * | 10/2003 | Shea | 482/8 |
| 6,913,079 | B2 * | 7/2005 | Tubel | 166/250.01 |
| 6,940,054 | B1 * | 9/2005 | Heggdal | 219/629 |
| 6,943,300 | B2 * | 9/2005 | Ekeberg et al. | 174/113 R |
| 6,973,244 | B2 | 12/2005 | Karlsen | |
| 6,978,825 | B1 * | 12/2005 | Baylot et al. | 165/45 |
| 7,158,703 | B2 * | 1/2007 | Mjelstad | 385/101 |
| 7,158,803 | B1 * | 1/2007 | Elliott | 455/512 |
| 7,686,073 | B1 * | 3/2010 | Reynolds | 166/65.1 |
| 7,753,111 | B1 * | 7/2010 | Reynolds | 166/65.1 |
| 2003/0094281 | A1 | 5/2003 | Tubel | |
| 2006/0113110 | A1 | 6/2006 | Leuchtenberg | |
| 2006/0175063 | A1 | 8/2006 | Balkanyi et al. | |
| 2007/0044992 | A1 | 3/2007 | Bremnes | |
| 2007/0205009 | A1 * | 9/2007 | Figenschou | 174/47 |
| 2007/0251694 | A1 * | 11/2007 | Ju et al. | 166/345 |
| 2007/0253778 | A1 * | 11/2007 | Figenschou | 405/169 |

FOREIGN PATENT DOCUMENTS

| | | | | |
|---|---|---|---|---|
| GB | 2326177 A | * | 12/1998 | E21B 17/01 |
| GB | 2326758 A | * | 12/1998 | H01B 7/14 |
| WO | WO 2005124095 A1 | * | 12/2005 | E21B 17/01 |

OTHER PUBLICATIONS

Supplementary European Search Report regarding European Patent Application No. 08849246.7 dated Jan. 15, 2013 (2 pages).

PCT International Search Report and Written Opinion, International App. No. PCT/US 08/79276, Dec. 12, 2008.

* cited by examiner

SUBSEA POWER UMBILICAL

TECHNICAL FIELD

This invention relates to supplying electrical power to subsea equipment, and more particularly, to a power umbilical that can be used for supplying electrical power in deepwater and ultra-deepwater applications.

BACKGROUND OF THE INVENTION

In offshore hydrocarbon production, there is typically a structure either a vessel such as a floating production storage and offloading (FPSO) vessel or a platform, at the surface of the sea positioned above a production field on the sea floor. There are typically several wellheads that are producing hydrocarbons to be conveyed to the vessel. Moreover, there is often other subsea equipment that requires electrical power to control, regulate, pre-treat, and/or monitor the hydrocarbon production. For example, such equipment can include, but not be limited to, a subsea pump, a subsea compressor, a control or distribution module, a lower marine riser package and blow-out preventer, an electrically submersible pump, a subsea separator, or various types of sensors and communication devices.

In order to provide such electrical power to the subsea equipment, a power umbilical extends from the structure at the surface of the sea to the field. The power umbilical typically registers with a stab or hub which receives the electrical power and distributes the electrical power through a plurality of control lines to each of the subsea equipment requiring such power.

Typically, the power umbilical utilizes copper cables as the conductor for conveying such electrical power from the vessel or structure at the surface of the sea to the subsea equipment. It has been observed that for deepwater (more than about 1500 feet depth) and ultra-deepwater (more than about 4000 feet depth), the weight of the copper itself causes deformation in an elongated manner or "creep" to occur to the copper. Such deformation or creep can ultimately lead to mechanical failure because the copper can become stretched and embrittled. However, even before such mechanical failure such deformation or creep creates losses with the electrical power being transmitted at the hangoff of the structure at the surface of the sea to the subsea equipment. For example, the creep can cause power losses or heat which can be disruptive to the subsea equipment—such as motors for the subsea pumps, electrically submersible pumps, and compressors. Generally speaking, wave disruption of electrical wave is a function of the distance or length the electrical power is being communicated or transmitted (e.g., the length of the conductor) and the magneticity of the materials adjacent the conductor. For small distances, any disruptions due to the magnetic properties of materials around or near the conductor are typically minimal. However, as the distance increases, such disruptions become larger and create a challenge because of the disruptions to the wave form of the electrical current.

Another problem that has been recognized with prior assemblies is hydrogen migration. For example, such hydrogen formation can occur when there are components comprising zinc within the umbilical. If hydrogen forms within the umbilical, then the hydrogen will try to find a path of least resistance to exit the umbilical. Sometimes the hydrogen is able to find a way through the outer jacket of the umbilical. However, it has also been observed that the hydrogen seeps through the insulators, which can prevent the water from seeping through to the conductors but not the smaller hydrogen molecules, and the hydrogen follows the conductor cables toward the ends of the umbilical. At the ends of the umbilical, the hydrogen typically becomes backed-up and begins to build pressure. When such occurrence is unknown to the operator, the high pressure hydrogen has been known to blow connection the end of the umbilical with an explosion. To prevent such explosions, operators are having to monitor hydrogen migration along the conductor cables, as well as relieving pressure when it reaches a predetermined amount.

SUMMARY OF THE INVENTION

An umbilical assembly for supplying power to subsea equipment includes an electrical conductor to convey an electrical current to the subsea equipment. The umbilical assembly also includes an insulator surrounding the conductor. The umbilical assembly also has a support member, having either non-magnetic properties or low-magnetic properties, positioned between the insulator and the conductor. The support member is adapted to connect to a structure at the surface of the sea. The support member supports the weight of the conductor.

In the umbilical assembly, the conductor can be a stranded conductor. The stranded conductor can include copper or aluminum cables. When copper cables are used, the supporting of the weight of the conductor with the support member can reduce creep. In the umbilical assembly, the conductor can selected from a type of conductor consisting of a stranded conductor, a solid conductor, and a segmented conductor.

In the umbilical assembly, the support member can be close-coupled with the conductor. In the umbilical assembly, the support member can also have a textured inner surface that enhances friction between the support member and the conductor.

In the umbilical assembly, the support member can be stainless steel. In the umbilical assembly, the support member can be AL 4565 alloy stainless steel or Duplex stainless steel. In the umbilical assembly, the support member can be a stainless steel having a chromium content of more than 19 weight percent. In the umbilical assembly, the support member can be a stainless steel having a chromium content of between 22 and 25 weight percent. In the umbilical assembly, the support member can be a stainless steel having a chromium content of more than 25 weight percent.

In the umbilical assembly, the support member can hermetically seal the conductor and prevent hydrogen migration along the conductor.

In the umbilical assembly, there can be a plurality of conductors, support members, and insulators extending parallel to each other. The umbilical assembly can also have an outer jacket enclosing the plurality of conductors, support members, and insulators.

In the umbilical assembly, the umbilical assembly can be adapted to extend to a depth of at least 1500 feet to supply power to the subsea equipment. In the umbilical assembly, the umbilical can also be adapted to extend to a depth of at least 4000 feet to supply power to the subsea equipment. In the umbilical assembly, the umbilical can also be adapted to extend to a depth of at least 10,000 feet to supply power to the subsea equipment.

Another aspect of the invention is a system for supplying power subsea to subsea equipment requiring electrical power. The system includes a structure associated with hydrocarbon production located at the surface of the sea. The system also includes a conductor extending from the structure toward the sea floor to communicate electrical power from the structure to the subsea equipment. An insulator surrounds the conductor. A support member, having either non-magnetic properties or low-magnetic properties, is positioned between the insulator and the conductor. The support member is connected to the structure at the surface of the sea. The support member supports the weight of the conductor.

In the system, the support member hermetically seals the conductor and prevents hydrogen migration along the conductor. In the system, the there can be a plurality of conductors, support members, and insulators extending parallel to each other. The system can also include an outer jacket enclosing the plurality of conductors, support members, and insulators.

The system can also include a subsea distribution module in electrical communication with the conductor and the subsea equipment. The distribution module can selectively distribute electrical power received from the structure to the subsea equipment.

In the system, the structure can provide power to the subsea equipment, which is positioned on the sea floor and operating in a deepwater environment or in an ultra-deepwater environment.

In the system, the support member can include stainless steel, and the conductor of electrically conductive cables can have copper cables. The supporting of the weight of the conductor with the support member can reduce creep associated with the copper cables. The conductor call also be a stranded conductor with a plurality of copper cables.

In the system, the conductor of electrically conductive cables can have cables selected from a group consisting of copper cables, aluminum cables, tin, silver, and a conductive alloy.

In the system, the support member can be close-coupled with the conductor. In the system, the support member can further have a textured inner surface that enhances friction between the support member and the conductor. In the system, the support member can eliminate creep for a predetermined lifetime of a hydrocarbon producing field.

Another aspect of the invention is a method of supplying electrical power from a structure at the surface of the sea to subsea electrical equipment. The method includes the step of extending a conductor from the structure to the subsea electrical equipment. The method includes the step of surrounding the conductor with an insulator. The method also includes the step of positioning a support member having either non-magnetic properties or low-magnetic properties between the insulator and the conductor. The method includes the step of connecting the support member to the structure. The method also includes the step of supporting the weight of the conductor in order to reduce creep associated with the weight of the conductor with a support member.

In the method, the step of supporting the weight with the conductor can also include eliminating creep associated with the weight of the conductor.

DETAILED DESCRIPTION OF THE INVENTION

Figure 1:
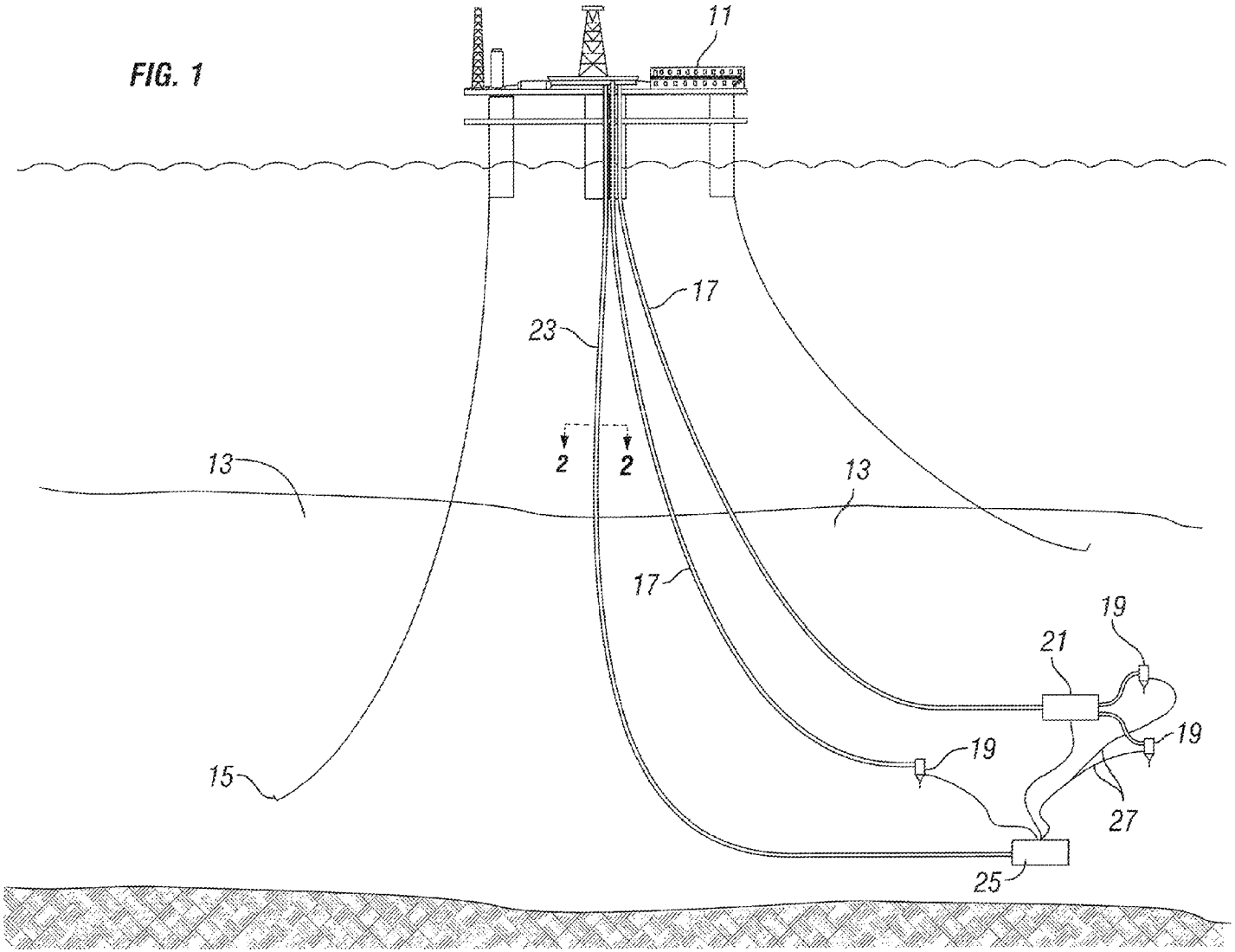
FIG. 1 is perspective view of a production facility providing electrical power to subsea equipment with an umbilical made in accordance with the present invention.

Referring to FIG. 1, a structure 11 is shown at the surface of the sea. Structure 11 is typically moored to a sea floor 13 by a plurality of mooring lines 15. While structure 11 is shown as a platform, it will be readily appreciated by those skilled in the art that structure 11 can alternatively be a floating production storage and offloading (FPSO) vessel. In an embodiment of the this invention, sea floor 13 is greater than or equal to 1500 feet deep such that structure 11 is supporting deepwater operations. In another embodiment of this invention, sea floor 13 is greater than or equal to 4000 feet deep such that structure 11 is supporting ultra-deepwater operations. As will be readily understood by those skilled in the art, "deepwater" and "ultra-deepwater" are terms of art which can vary slightly depending upon those you talk with and time. For the purposes of this invention, it is contemplated that these terms shall be as listed above.

A production riser 17 communicates hydrocarbons produced from a plurality of wellheads 19 to structure 11. In an embodiment of the invention, there is a plurality of production risers 17 communicating hydrocarbons to structure 11. Risers 17 can receive hydrocarbons directly from a one of wellheads 19, or alternatively receive hydrocarbons from another subsea collection structure 21 such as a collection manifold or a subsea pump which is in fluid communication with riser 17.

A power umbilical 23 extends from structure 11 toward sea floor 13 to provide electrical power to the subsea equipment. As will be readily appreciated by those skilled in the art, power umbilical can also be used for communication and control purposes by including additional lines within power umbilical. In an embodiment of the invention, power umbilical registers with a distribution module 25. Distribution module 25 receives the electrical power from power umbilical and distributes it to the other subsea equipment, such as wellheads 19 and collection structure 21, via lines 27. As will be readily appreciated by those skilled in the art, distribution module 25 could distribute power to a variety of subsea electrical equipment that are not illustrated but are contemplated as part of the present invention. Many such subsea equipment are listed above here in the Background of the Invention.

Figure 2:
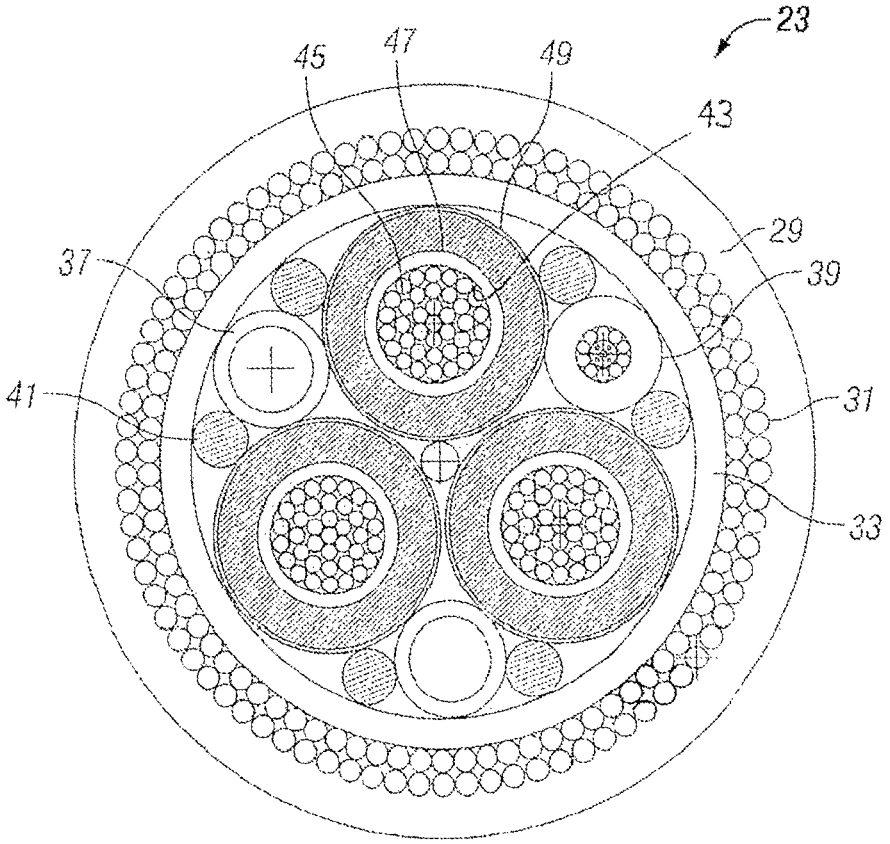
FIG. 2 is sectional view of the umbilical of FIG. 1 taken along line 2-2.

Referring to FIG. 2, in an embodiment of the invention umbilical 23 includes an outer jacket 29 and an armor package 31 that sealingly protects the internal components of umbilical 2 from the sea water as well as providing a first layer of protection from structural damage, for example resulting from impacts, friction, and bending during deployment. An inner liner or belt 33 is carried within jacket 29 and armor package 31. Belt 33 provides further protection for the internal components of umbilical 23, as well as defining an inner or effective diameter of umbilical 23.

In an embodiment of the invention, belt 33 carries a tubular lubricant conduit 37 and a communication conduit 39. Communication conduit 39 preferably carries communications means such as fiber optic lines. Lubricant conduit 37 call provide lubrication fluid to the subsea equipment. Alternatively, or additionally if there are a plurality of lubricant conduits as shown in FIG. 2, lubricant conduit 37 can provide hydraulic fluid for use in actuating hydraulically controlled subsea and downhole mechanisms. Belt 33 can also carries carbon fiber rods 41 intermittently spaced therein to increase the longitudinal strength of umbilical 23, while decreasing the in-water weight as compared to prior umbilicals relying solely upon belt 33, armor package 31, and jacket 29 for such strength.

Umbilical 23 includes a power cable 43 that is also carried within belt 33. In an embodiment of the invention, there is a plurality of power cables 43. According to a best mode of the invention, such power cables 43 are symmetrically spaced within belt 33, with lubricant conduit 37, communication conduit 39, and carbon fiber rods 41 embedded in the interstitial spaces or interspatial locations therebetween, as best illustrated in FIG. 2.

According to an embodiment of the invention, power cables 43 include a conductor 45. Conductor 45 can be a cable or line having an acceptable conductance. For example, copper and aluminum both have conductive properties that are desirable for conveying electrical current. In conventional offshore umbilicals, conductor 45 is a stranded conductor having a plurality of small conductor lines or cables that are bunched or grouped together. In an embodiment of the invention, when conductor 45 is a stranded conductor with a plurality of copper cables, it is contemplated that conductor 45 will be about one-half inch in diameter. With conductor 45 having a one-half inch diameter, umbilical 23 having the components illustrated in FIG. 2, for example, would typically have an outer diameter around the circumference of jacket 29 of about three and one-quarter inches, and an inner diameter associated with belt 33 of about 2.22 inches. As will be readily appreciated by those skilled in the art, such dimensions are exemplary based upon the components illustrated in FIG. 2, and can vary with an increase in size of conductor 45, number of power cables 43, and number of other components such as lubricant conduit 37, communication conduit 39, and carbon fiber rods 41.

While a single large cable or line (solid conductor) can be used, such a cable or line is generally less flexible and has a shorter operational life before fatigue failure. As will be readily appreciated by those skilled in the art, a segmented conductor is also contemplated as an alternative conductor. In an embodiment of this invention, conductor 45 comprises a stranded conductor having lines that are copper. As will be readily appreciated by those skilled in the art, other conductive metals may be utilized as well. Such alternate conductors may increase the diameter of conductor 45. While in some situations it may not be desirable to increase the size of umbilical 23 by increasing the size of conductor 45 when using Aluminum (typically doubling in diameter), such an arrangement can decrease the overall weight of umbilical because Aluminum weighs less. Some such alternate conductors, such as aluminum would not experience creep or deformation like copper conductors; however, the increase in diameter to achieve the necessary communication of electrical power may not be beneficial at this time.

A strength or support conduit member 47 surrounds each conductor 45. In an embodiment of the invention, support member or conduit 47 is close-coupled with conductor 45 so that support member 47 carries the weight associated with each conductor 45. In such an arrangement, conductor 45 can be held in place relative to an interior surface of support member 47 by frictional forces due solely from an interference-fit relationship associated with the close coupling. Alternatively, support member 47 may have a textured inner surface 48 to increase frictional forces such that the close coupling of support member 47 does not need to create as much of an interference fit.

In an embodiment of the invention, support member 47 comprises metal tubing that is seam welded and swaged around conductor 45. In such an arrangement, support member 47 hermetically seals conductor 45 and therefore prevents the problem of hydrogen migration along conductor 45 as discussed above herein. Alternatively, support member 47 can comprise a plurality of metal members held together by a nonmetallic substrate, similar to an armor package.

In either embodiment, however, support member 47 should have either non-magnetic or low magnetic properties based upon their material compositions, such as stainless steel. As will be readily understood by those in the art, magnetic properties are typically associated with the presence of iron carbite (Fe3C) in a material. It is preferred if no iron carbite is present, such that support member 47 is non-metallic. However, in the manufacturing processes associated with support member 47, even stainless steel, a small amount of iron carbite may form. Such formations can be acceptable so long as such formations create only low magnetic properties for support member 47. Such low magnetic properties are preferably such that there is not a significant disruption of the waveforms associated with the electrical current due to any electromagnetic interference caused by magnetic elements in close proximity to conductor 45.

Examples of acceptable non- or low magnetic property stainless steels include "duplex" stainless steel as well as AL 4565 Alloy stainless steel. Duplex stainless steels typically have a mixed microstructure of austenite and ferrite. Typically, during production, the manufacturer aims at producing a 50:50 mix of austenite and ferrite. However, in commercial alloys the mix may be 40:60 respectively. Duplex stainless steels are often characterized by high chromium (19-32 wt. %) and molybdenum (up to 5 wt. %) and lower nickel contents than austenitic stainless steels. AL 4565 alloy stainless steels (UNS S34565) are "superaustenitic stainless steels" which typically have high strength and toughness. AL 4565 alloy stainless steels have a typical material composition of 23-25 wt. % chromium, 5-7 wt. % Manganese, 4-5 wt. % Molybdenum, 0.4-0.6 wt. % Nitrogen, 16-18 wt. % Nickel, less than or equal to 0.01 wt. % Carbon, and the remainder being Iron.

As will be appreciated by those skilled in the art, the magnetic properties of a stainless steel typically decrease as the chromium content increase, whereas a 32 wt. % chromium has substantially no magnetic properties. At this time, it is contemplated that a high allow stainless steel having a chromium content of 19-32 wt. % is acceptable (such as with the AL 4565 stainless steel), as well as 22-25 wt. % with the Duplex stainless steels. As will be readily appreciated by, those skilled in the art, it would also be acceptable to use other such high allow stainless steels such as "Super Duplex" stainless steel, which has at least 25 wt. % chromium.

In an embodiment of the invention, power cable 43 also includes an insulator 49 that surrounds and encloses both conductor 45 and strength member 47. Strength member 47 and insulator 49 act together to help to transfer heat from the conductive lines within conductor 45, as well providing additional protection against sea water. Positioning support member 47 between insulator 49 and conductor 45 is contemplated as helping to accomplish the reduction in the size of the support member 47 as well as allowing support member to carry the weight of conductor 45. Having support member 47 carry the weight of conductor 45 helps to reduce and/or eliminate the creep or deformation associated with the conductor 45 over a predetermined lifetime of the hydrocarbon producing field (typically twenty (20) years) because the conductor lines are no longer supporting themselves.

According to an embodiment of this invention umbilical 23 allows structure 11 to provide electrical power to subsea equipment when sea floor 13 is greater than or equal to 1500 feet deep such that structure 11 is supporting deepwater operations. In another embodiment of this invention, umbilical 23 allows structure 11 to provide electrical power to subsea equipment when sea floor 13 is greater than or equal to 4000 feet deep such that structure 11 is supporting ultra-deepwater operations. In yet another embodiment, umbilical 23 allows structure 11 to provide electrical power to subsea equipment when sea floor 13 is greater than or equal to 10,000 feet deep. In each of these embodiments, when support member 47 is a tubular metal conduit that is welded and swaged around conductor 45 conductor 45 is hermetically sealed to prevent the problem of hydrogen migration along conductor 45 as discussed above herein. In each of these embodiments, the weight of conductor 45 is transferred and carried by support member 47, which helps to reduce and eliminate creep for metal conductors such as copper.

While in the foregoing specification this invention has been described in relation to certain embodiments and preferred embodiments thereof, and many details have been set forth for purpose of illustration, it will be apparent to those skilled in the art that the invention is susceptible to alteration and that certain other details described herein can vary considerably without departing from the basic principles of the invention. For example, umbilical 23 is illustrated as a being catenary type, but may also be vertical or an S-type curve due to buoys (e.g. a "Lazy Wave"). Moreover, the number of power cables 43 can be altered according to specific design requirements. Furthermore, support members 47 can comprise other materials having non-magnetic or low magnetic properties than those specifically provided as examples.

What is claimed is:

1. An umbilical assembly for supplying power to subsea equipment, comprising:

an outer jacket and an armor package that sealingly protects the internal components of the umbilical assembly from seawater and provides a first layer of protection from structural damage;

an inner liner carried within the outer jacket and the armor package;

an electrical conductor to convey an electrical current to the subsea equipment;

an insulator surrounding the conductor; and a support member comprising stainless steel and having either nonmagnetic properties or low-magnetic properties, positioned between the insulator and the conductor such that the support member seals the conductor and prevents hydrogen migration along the conductor, the support member being adapted to connect to a structure at the surface of the sea, and the support member supporting the weight of the conductor.

2. The umbilical assembly of claim 1, wherein the conductor is a conductor selected from a group consisting of a stranded conductor, a solid conductor, and a segmented conductor.

3. The umbilical assembly of claim 1, wherein the conductor comprises a stranded conductor with copper cables, and the supporting of the weight of the conductor with the support member reduces creep.

4. The umbilical assembly of claim 1, wherein the support member is close-coupled with the conductor.

5. The umbilical assembly of claim 1, wherein the support member further comprises a textured inner surface that enhances friction between the support member and the conductor.

6. The umbilical assembly of claim 1, wherein the support member comprises a stainless steel having a chromium content of more than 19 weight percent.

7. The umbilical assembly of claim 1, wherein the support member comprises a stainless steel having a chromium content of between 22 and 25 weight percent.

8. The umbilical assembly of claim 1, wherein the support member comprises a stainless steel having a chromium content of more than 95 weight percent.

9. The umbilical assembly of claim 1, wherein the umbilical assembly comprise a plurality of conductors, support members, and insulators extending parallel to each other, and the umbilical assembly further comprises:

an outer jacket enclosing the plurality of conductors, support members, and insulators.

10. The umbilical assembly of claim 1, wherein the umbilical is adapted to extend to a depth of at least 2000 feet to supply power to the subsea equipment.

11. The umbilical assembly of claim 1, wherein the umbilical is adapted to extend to a depth of at least 4000 feet to supply power to the subsea equipment.

12. The umbilical assembly of claim 1, wherein the umbilical is adapted to extend to a depth of at least 10,000 feet to supply power to the subsea equipment.

13. The umbilical assembly of claim 1, wherein the inner liner carries a lubricant conduit and a communication conduit.

14. A system for supplying power subsea to subsea equipment requiring electrical power, comprising:

a structure associated with hydrocarbon production located at the surface of the sea;

an umbilical assembly extending from the structure toward the sea floor to communicate electrical power from the structure to the subsea equipment wherein the umbilical assembly comprises an outer jacket and an armor package that sealingly protects the internal components of the umbilical assembly from seawater and provides a first layer of protection from structural damage; an inner liner carried within the outer jacket and the armor package; and a conductor;

an insulator surrounding the conductor; and a support member comprising stainless steel and having either non-magnetic properties or low-magnetic properties, positioned between the insulator and the conductor such that the support member seals the conductor and prevents hydrogen migration along the conductor, the support member being connected to the structure at the surface of the sea, and the support member supporting the weight of the conductor.

15. The umbilical assembly of claim 14, wherein the support member hermetically seals the conductor and prevents hydrogen migration along the conductor.

16. The system of claim 14, wherein the assembly comprise a plurality of conductors, support members, and insulators extending parallel to each other, and further comprises:

an outer jacket enclosing the plurality of conductors, support members, and insulators.

17. The system of claim 14, further comprising a subsea distribution module in electrical communication with the conductor and the subsea equipment, the distribution module selectively distributing electrical power received from the structure to the subsea equipment.

18. The system of claim 14, wherein the structure is supporting the subsea equipment, which is positioned on the sea floor and operating in an ultra-deepwater environment.

19. The system of claim 14, wherein:

the conductor comprises copper and the supporting of the weight of the conductor with the support member eliminates creep for a predetermined lifetime of a hydrocarbon producing field.

20. The umbilical assembly of claim 19, wherein the conductor comprises a stranded conductor with a plurality of copper cables.

21. The system of claim 14, wherein the support member is close-coupled with the conductor.

22. The system of claim 14, wherein the support member further comprises a textured inner surface that enhances friction between the support member and the conductor.

23. A method of supplying electrical power from a structure at the surface of the sea to subsea electrical equipment, comprising:

extending an umbilical assembly from the structure to the subsea electrical equipment wherein the umbilical assembly comprises an outer jacket and an armor package that sealingly protects the internal components of the umbilical assembly from seawater and provides a first layer of protection from structural damage; an inner liner carried within the outer jacket and the armor package; and a conductor;

surrounding the conductor with an insulator;

positioning a support member comprising stainless steel having either non-magnetic properties or low-magnetic properties between the insulator and the conductor such that the support member is configured to seal the conductor and prevent hydrogen migration along the conductor;

connecting the support member to the structure; and supporting the weight of the conductor in order to reduce creep associated with the weight of the conductor with a support member.

24. The method of claim 23, wherein the step of supporting the weight with the conductor further comprises eliminating creep associated with the weight of the conductor.

* * * * *